US010199780B2

(12) United States Patent
Volkmann et al.

(10) Patent No.: US 10,199,780 B2
(45) Date of Patent: Feb. 5, 2019

(54) ELECTRIC SHIELDING CONTACT DEVICE

(71) Applicant: TE Connectivity Germany GmbH, Bensheim (DE)

(72) Inventors: Daniel Volkmann, Lautertal (DE); Olivier De Cloet, Lorsch (DE); Christian Schrettlinger, Bensheim (DE); Wolfgang Mueller, Darmstadt (DE); Jochen Brandt, Stoedtlen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/850,633

(22) Filed: Dec. 21, 2017

(65) Prior Publication Data

US 2018/0183190 A1 Jun. 28, 2018

(30) Foreign Application Priority Data

Dec. 23, 2016 (EP) ..... 16206804

(51) Int. Cl.

| | |
|---|---|
| ***H01R 4/24*** | (2018.01) |
| ***H01R 13/6592*** | (2011.01) |
| ***H01R 4/18*** | (2006.01) |
| ***H01R 9/05*** | (2006.01) |
| ***H01R 4/20*** | (2006.01) |
| ***H01R 4/22*** | (2006.01) |
| ***H01R 24/40*** | (2011.01) |
| ***H01R 43/048*** | (2006.01) |
| *H01R 13/11* | (2006.01) |
| *H01R 103/00* | (2006.01) |

(52) U.S. Cl.

CPC ..... *H01R 13/6592* (2013.01); *H01R 4/184* (2013.01); *H01R 4/20* (2013.01); *H01R 4/22* (2013.01); *H01R 9/0518* (2013.01); *H01R 24/40* (2013.01); *H01R 43/048* (2013.01); *H01R 4/188* (2013.01); *H01R 13/111* (2013.01); *H01R 2103/00* (2013.01); *H01R 2201/26* (2013.01)

(58) Field of Classification Search

CPC ..... H01R 9/0518; H01R 4/184
USPC ..... 439/442, 585, 877, 878
See application file for complete search history.

(56) References Cited

U.S. PATENT DOCUMENTS

| | | | | |
|---|---|---|---|---|
| 3,670,298 A | | 6/1972 | Klumpp, Jr. | |
| 5,975,965 A | * | 11/1999 | Jordan | H01R 9/0518 439/877 |
| 2006/0057904 A1 | * | 3/2006 | Sakaguchi | H01R 4/185 439/877 |

(Continued)

FOREIGN PATENT DOCUMENTS

CN 102709717 A 10/2012

OTHER PUBLICATIONS

European Search Report, dated Feb. 13, 2017, 12 pages.

*Primary Examiner* — Tho D Ta
(74) *Attorney, Agent, or Firm* — Barley Snyder

(57) ABSTRACT

An electric shielding contact device in the form of a hollow cylinder that has a contact section and a crimping section. The contact section serves to electrically contact the electric shielding contact device with an electric counter contact. The crimping section serves to attach the electric shielding contact device to an electrical cable upon crimping of the crimping section and has a gaping opening shaped and sized to become a slit when the crimping section of is crimped and the electric shielding contact device attached to the electrical cable.

12 Claims, 3 Drawing Sheets

(56) References Cited

U.S. PATENT DOCUMENTS

| | | | | |
|---|---|---|---|---|
| 2013/0023155 | A1 | 1/2013 | Ryosuke, II | |
| 2015/0255886 | A1 * | 9/2015 | Schmidt | H01R 4/183<br>439/877 |

* cited by examiner

ELECTRIC SHIELDING CONTACT DEVICE

CROSS REFERENCE TO RELATED APPLICATIONS

This application claims the benefit of the filing date under 35 U.S.C. § 119(a)-(d) of European Patent Application No. 16206804, filed 23 Dec. 2016.

FIELD OF THE INVENTION

The present invention relates to an electric shielding contact device having a hollow cylindrical shielding contact for electrically contacting an electric counter contact.

BACKGROUND

In the electrical domain (electronics, electrical engineering, electrics, electrical energy technology, etc.), a large number of electrical connection means and devices, jack and/or pin connectors, etc., in the following referred to as electrical counter-connectors or counter-connection devices, are known which serve to transfer electrical currents, voltages, signals and/or data with a large bandwidth of currents, voltages, frequencies, and/or data rates. In a low, medium, or high voltage and/or current range, and, in particular, in the automotive industry, such connectors have to provide a short term and/or long term transfer of electrical power, signals, and/or data in cold, warm or hot, contaminated, moist, and/or chemically aggressive environments. Due to a wide range of applications, a large number of specifically configured connectors is known.

Such connectors and their housings can be assembled at an electrical line, a cable, a cable harness, and/or an electrical means or device, such as, for example, at/in a housing or on/at a circuit board of an electrical, electro-optical, or electronic component, or such an appliance or aggregate; in the latter case, one often speaks of a counter-connector device. If a connector is only located at a line, a cable, or a cable harness, it is usually referred to as a flying plug-connector, a plug, or a coupling, and, if it is located at/in an electrical, electronic, or electro-optical component, the component is usually referred to as a built-in connector, such as a built-in plug or a built-in jack. Furthermore, a connector at/in such an appliance or aggregate is often also referred to as a plug receiver or a header, the connector often having a support collar which is intended to ensure a robust connection.

Electrical connectors must ensure proper transmission of electrical signals and/or electrical power, wherein connectors corresponding to one another (connectors and counter-connectors) typically have fastening or locking means for permanently but generally releasably fastening or locking of the connector at/in the counter-connector. Furthermore, corresponding electrical contact elements, such as an actual electrical contact means and/or an actual electrical shielding contact, (i.e., an electrical connection device of the connector), must be securely held in the latter. Since the housings of the connectors are usually subject to a certain standardization, for example, the FAKRA standard (FAKRA=Fachkreis Automobil, automotive specialist group, the most important dimensions of the housings of different manufacturers have the same measurements.

Efforts are constantly being made to improve and/or to scale down electrical connectors and/or to make them less expensive. The advancing miniaturization does not stop at the cross-sections of the cables and/or the connection devices involved, either. Efforts are thus being made to reduce the dimensions of, for example, coaxial cables and their connecting devices in order to reduce installation space, to be able to make good use of a line cross-section with a given maximum current load capacity, and to save resources, in particular copper. Furthermore, miniaturization results in a desired weight saving. Of course, this relates not only to coaxial cables, but to other cables and their connecting devices, as well.

SUMMARY

An electric shielding contact device, constructed in accordance with the present invention, comprises a hollow cylindrical shielding contact that has a contact section for electrically contacting an electric counter contact and a crimping section. The crimping section attaches the hollow cylindrical shielding contact to an electrical cable upon crimping the crimping section and has a gaping opening shaped and sized to become a slit when the crimping section of the hollow cylindrical shielding contact is attached to an electrical cable.

BRIEF DESCRIPTION OF THE DRAWINGS

The figures, which are given only by way of example, show as follows.

DETAILED DESCRIPTION OF THE EMBODIMENT(S)

Figure 2:
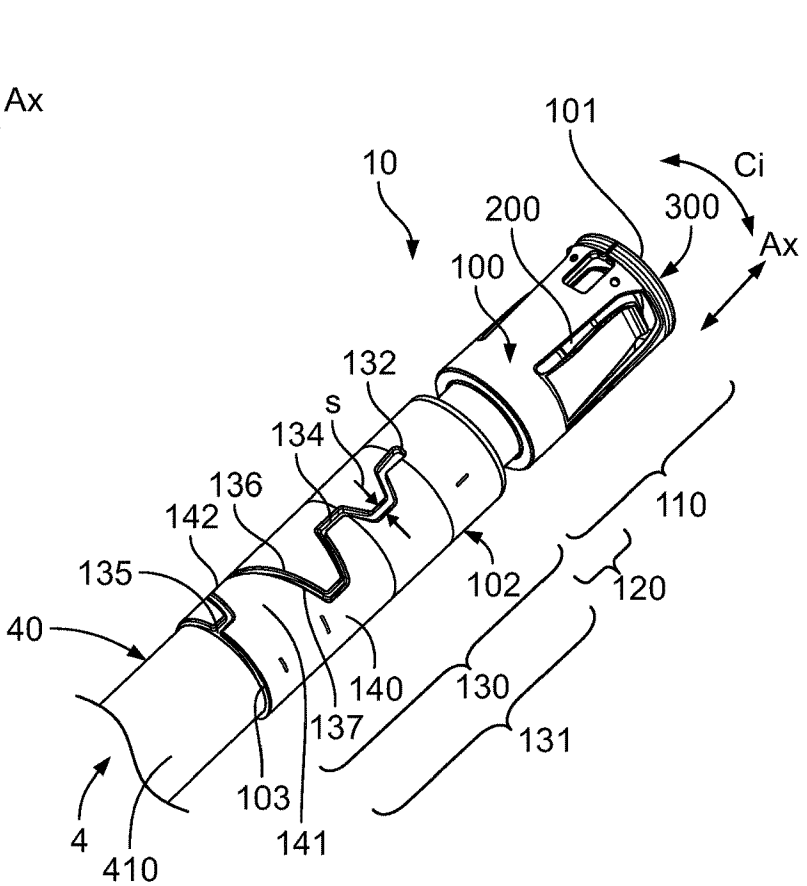
FIG. 2 is a perspective view from above and behind, of an assembled electrical cable, wherein the inventive contact device comprising the inventive shielding contact is completely assembled on/at the cable.

The figures only show those sections of the inventive subject matter which are necessary for understanding the present invention. In spite of the present invention being described and illustrated in detail by means of preferred embodiment examples, the present invention is not limited by these embodiment examples. Other variations may be derived therefrom and/or from the above (description of the invention) without exceeding the protective scope of the present invention.

The present invention is explained in more detail below by means of exemplary embodiments with reference to the accompanying detailed drawings which are not true to scale. Sections, elements, component parts, entities, components, and/or schematics which have an identical, univocal, or analogous design and/or function are provided with the same reference signs in the description of the figures and are identified with the same reference numbers in the drawings.

The shielding contact according to the present invention is in a first aspect formed mainly in a hollow cylindrical manner and preferably comprises a front contact section for electrically contacting an electric counter contact and preferably a rear crimping section for crimping the shielding contact on/at the electrical cable. In at least a rear portion of the crimping section, the crimping section gapes from a material of the shielding contact, wherein the crimping section is preferably constructed in such a way that during crimping the gaping opening in the shielding contact can be closed to become a slit. The term "slit" is to be understood as a small gap inside the shielding contact, wherein the preferably direct distances (i.e., diameters) between the two opposite edges of the slit are mainly or substantially the same. The diameter of the slit is the shortest distance between the first edge and the second edge constituting the slit and is identified as "s".

In this context, the two edges of the slit may partially abut against each other in at least elastic recovery during the crimping process. An analogy to the term "slit" would be, for example, groove, slot, seam, joint, splice, interstice fissure, etc. Herein, an inner beginning (i.e., start location of the slit inside in the shielding contact and an outer ending (i.e., end location) of the slit outside at the shielding contact may derive from a form of the slit.

According to the present invention, a shielding contact having the opening, in other words, a shielding contact prior to crimping or a final crimping/mounting, is not in a pre-bent or pre-rolled condition. In a pre-bent or pre-rolled condition, the crimping section would be more closed. In other words, the former opening would be in a pre-closed or nearly closed state, whereby the slit is partially constituted.

Preferably, the opening and/or the slit has a start location inside the material of the shielding contact (offset or stepped-slit). Further, preferably the opening and/or the slit has an end location outside at the material of the shielding contact. Furthermore, preferably apart from only the start location, the opening and/or the slit is composed of only two opposing edges. One edge is a first inner edge of the opening and later on, after crimping of the slit, and the other edge is a second inner edge of the opening and later on of the slit.

In an embodiment of the present invention, the slit is free from an extension, mainly, or substantially in a circumferential direction of the shielding contact. For example, there is no substantial extension at/in the slit which mainly or substantially extends partly around the shielding contact solely in a circumferential direction of the shielding contact.

In an embodiment of the present invention, the crimping wall comprises at its two inner circumferential length-end portions one tooth or a plurality of teeth and one recess or a plurality of recesses. A recess of one inner circumferential length end portion may be complementary formed to a corresponding tooth of the opposite inner circumferential length-end portion of the crimping wall. A shielding contact may for example comprise one, two, three, four, or more teeth at one inner circumferential length end portion of the crimping wall, and the opposing inner circumferential length-end portion comprises an identical number of complementary formed recesses, or vice versa.

In an embodiment of the present invention, the start location of the opening and/or the slit comprises a recess in the material of the shielding contact, wherein the recess comprises an extension in circumferential direction. The extension of the recess in circumferential direction is preferably smaller than: 1.2-times, 1.5-times, 2-times, 3-times, 4-times, 5-times, 6-times, 8-times, or 10-times of a diameter of the slit in the closed state of the crimping section. Such a recess may be shaped circular, elliptical, triangular, square, rectangular, irregular, etc.

A cross-sectional measurement of at least the rear portion of the crimping section may be substantially the same along its axial direction, or a cross-sectional measurement of at least the rear portion of the crimping section may increase from a mid-portion in the shielding contact to the rear end of the shielding contact. In the latter case, in at least the rear portion of the crimping section its cross-sectional measurement increases because of a growing opening in the shielding contact from the mid-portion towards the rear end of the shielding contact.

In an embodiment of the present invention, in at least the rear portion of the crimping section an idealized cross-section area of the crimping section substantially increases from the mid-portion in the shielding contact to the rear end of the shielding contact. A bottom line of at least the rear portion of the crimping section may be tilted at an angle to a bottom line of a residual shielding contact, wherein the angle preferably measures less than or is mainly or substantially equal to 10°, 8°, 6°, 5°, 4°, 3°, 2°, 1°, or 0.5°. In this context, an angle of 2.5°±1°, particularly of 2.5°±0.5° is preferred. Of course, the angle may be larger than 10°.

According to the present invention, the electric counter contact may be constituted as a counter shielding contact. Further, an electric counter contact may be constituted as an inventive electric shielding contact. During the crimping process, the gaping opening in the shielding contact can be closed to a single slit. Further, the slit is preferably constituted as an offset- or a stepped-slit. Furthermore, the shielding contact may comprise a middle transitional section between the contact section and the crimping section.

According to the present invention, the crimping section is preferably actually free from any crimping flanges, crimping wings, or crimping flanks; according to the present invention, the open crimping wall is closed during the crimping process. Further, a tooth closer to the mid-portion of the shielding contact may be smaller than a tooth nearer to the rear end of the shielding contact. Furthermore, a recess nearer to the mid-portion of the shielding contact may be smaller than a recess nearer to the rear end of the shielding contact. Moreover, the opening and/or the slit may essentially be constituted by only two inner circumferential length end portions of the single crimping wall.

The contact device according to the present invention comprises an electric contact means, wherein the contact device further comprises an inventive electric shielding contact. The contact means may be designed as a male, a pin, a tab, a female, a jack, a hybrid, etc., contact means. Between the shielding contact and the contact means, a dielectric of the contact device may be arranged. The contact device may be, respectively, constituted as a male contact device, a pin contact device, a tab contact device, a female contact device, a jack contact device, or a hybrid contact device.

The preassembled or assembled cable according to the present invention comprises an electrical contact device at least electrically and/or mechanically connected to an electrical cable, wherein the contact device comprises an inventive shielding contact, and/or the contact device is constituted as an inventive contact device. Herein, the electric contact means of the connection device is securely connected electromechanically to an inner electric conductor of the coaxial cable. Further, the shielding contact of the connection device is or may be securely connected electromechanically to an outer electric conductor of the coaxial cable.

Additionally, the shielding contact is or may be securely connected mechanically to an outer electric conductor of the coaxial cable. Between the shielding contact and the contact means/an inner electrical insulation of the cable, the dielectric of the contact device may be arranged. Further, the inner start location of the slit in the shielding contact preferably lies above the outer conductor, and the outer end location of the slit in the shielding contact lies above the outer insulation of the cable.

According to the present invention, one or a plurality of transverse slots in an outer geometry of an electric contact means is replaced by lengthwise slits in the outer geometry. An advantage of the present invention is a higher signal integrity performance for high speed transmission of data, wherein smaller tolerances are feasible. For example, an inventive high density mini-coax system having a diameter of 3.6 mm reaches transmission rates of 9 GHz in comparison to a coax system from the state of the art having a diameter of 6 mm and which reaches transmission rates of at most 6 GHz.

In the following, the present invention is explained in more detail in conjunction with embodiment examples of an embodiment of a variant of an electric shielding contact 100, preferably a mini-coaxial shielding contact 100, for an inventive contact device 10, preferably a mini-coaxial contact device 10. However, the present invention is not limited to such a variant, such an embodiment, and/or the subsequently explained embodiment examples, but is of a more basic nature, so that the present invention may be applied to all contacts means (terminals), preferably jacks, contact devices, connectors, etc. In this context, the present invention may be used wherever electricity has to be transmitted in the form of currents, voltages, signals, frequencies, and/or data.

Referring to the drawings, the present invention includes an outer mini-coaxial shielding contact 100 for the mini-coaxial contact device 10, preferably according to the FAKRA standard (FAKRA Automobil (automotive specialist group, such as LV 214 or another), in particular for RF or HF plug connections (RF: Radio Frequency, HF: High Frequency). The contact device 10 may be designed, for example, as male/pin/tab/female/jack/hybrid contact device 10 further comprising an inner electric contact means 300, for example, a male/pin/tab/female/jack/hybrid mini-contact means as shown in FIG. 5.

Figure 5:
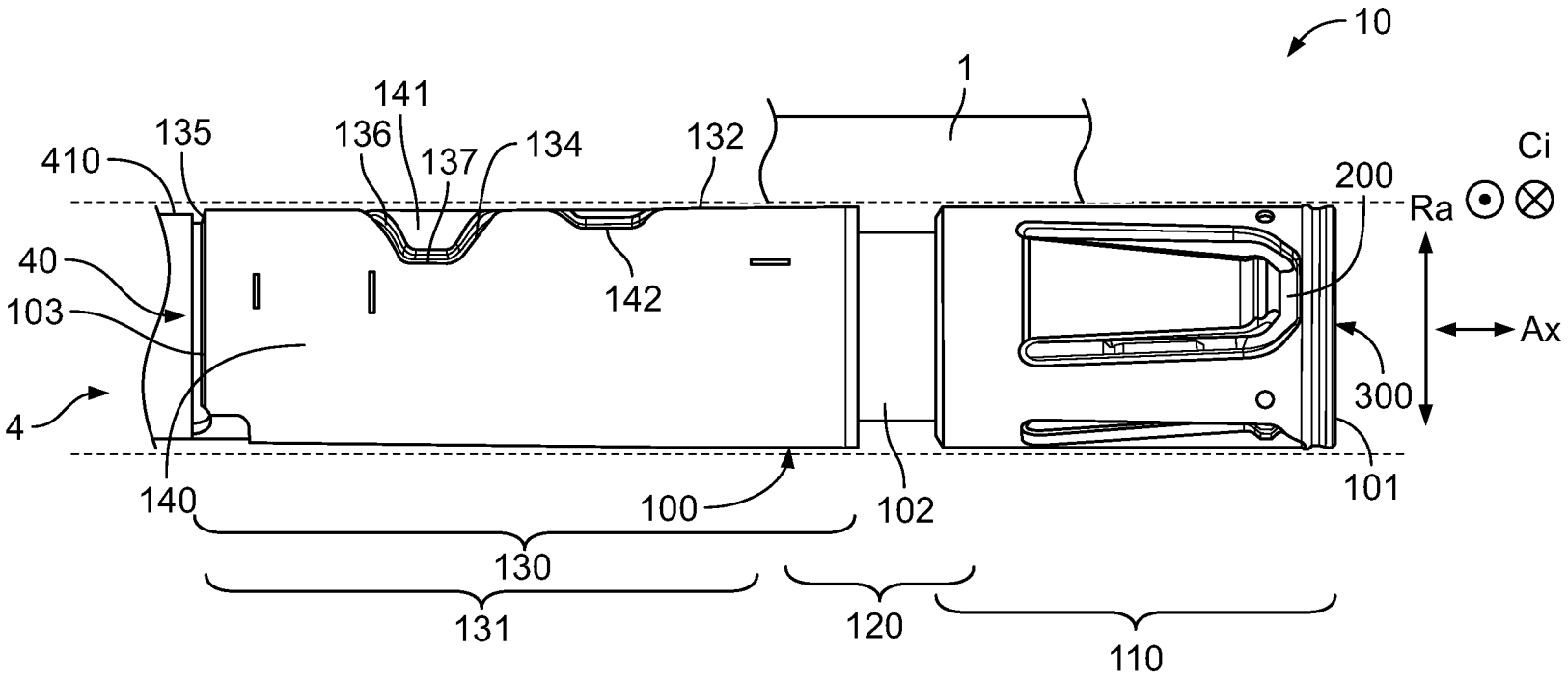
FIG. 5 is a two-dimensional top view of the assembled electrical cable from FIG. 2, wherein the gaping opening is closed and became a slit in the crimping, which can be seen from above.

The contact device 10 and the shielding contact 100 may be assembled on/at an electrical cable 40 as shown in FIGS. 2 and 5, in particular a copper and/or an aluminum cable 40, a cable harness, etc. A pre- or completely assembled or manufactured electrical cable 4 is, for example, intended to be locked in an electrical connector 1, a flying coupling 1, a built-in/plug male/female/hybrid connector 1, a male/female/hybrid receiver 1, a header 1, an interface 1, etc.

The shielding contact 100 comprises at its front an electric contact section 110 and at its rear a crimping section 130, wherein the contact section 110 may overlap with the crimping section 130 (not shown). There is, for this embodiment of the present invention being described, a transitional section 120 between the contact section 110 and the crimping section 130. Further, the contact section 110 comprises at its front a front end 102 as part of a connector face of the contact device 10 of the shielding contact 100 and the crimping section 130 has at its rear a rear end 103 of the shielding contact 100. A mid-portion 102 of the shielding contact 100 is between the front end 102 and the rear end 103, Before the shielding contact 100 is subjected to crimping (i.e., the open state of the crimping section 130), the crimping section 130, at a rear portion 131 of the crimping section 130 as illustrated, has a gaping opening 133 that is identified as a gaping crimping section 130. An open slit 134 results after crimping. After crimping (i.e., closed state of the crimping section 130) of the shielding contact 100, the rear portion 131 of the crimping section 130 has the slit 134 (i.e., closed crimping section 130, closed opening (133). In other words, crimping shapes (i.e., plastic deformation) the gaping opening 133 of the rear portion 131 to the slit 134.

The gaping opening 133 and subsequently the slit 134 are in the rear portion 131 or the crimping section 130 in such a way that it has a start location 132 inside a material of the rear portion 131 or the crimping section 130. In other words, the gaping opening 133 and subsequently the slit 134 begins inside the material of the rear portion 131 or the crimping section 130, proceeds through the rear portion 131 or the crimping section 130, and has an end location 135 outside at the material of the rear portion 131 or the crimping section 130. In this context, the rear portion 131 and/or the crimping section 130 is constituted by a single crimping wall 140 comprising the gaping opening 133 and subsequently the slit 134.

Beginning at the rear end 103 of the shielding contact 100 and prior to crimping, the crimping wall 140 has substantially U-shaped cross-sections, wherein the circumferentially Ci free ends of the arms of the "Us" draw ever nearer the closer the U-shaped cross-sections come inside (i.e., start location 132) the shielding contact 100. In other words, in a first aspect, the gaping opening 133 has a form of a spherical triangle inside the shielding contact 100. After crimping, the cross-sections of the rear portion 131 or the crimping section 130 along the slit 134 are substantially O-shaped, wherein the "Os" are open at a single location.

Figure 3:
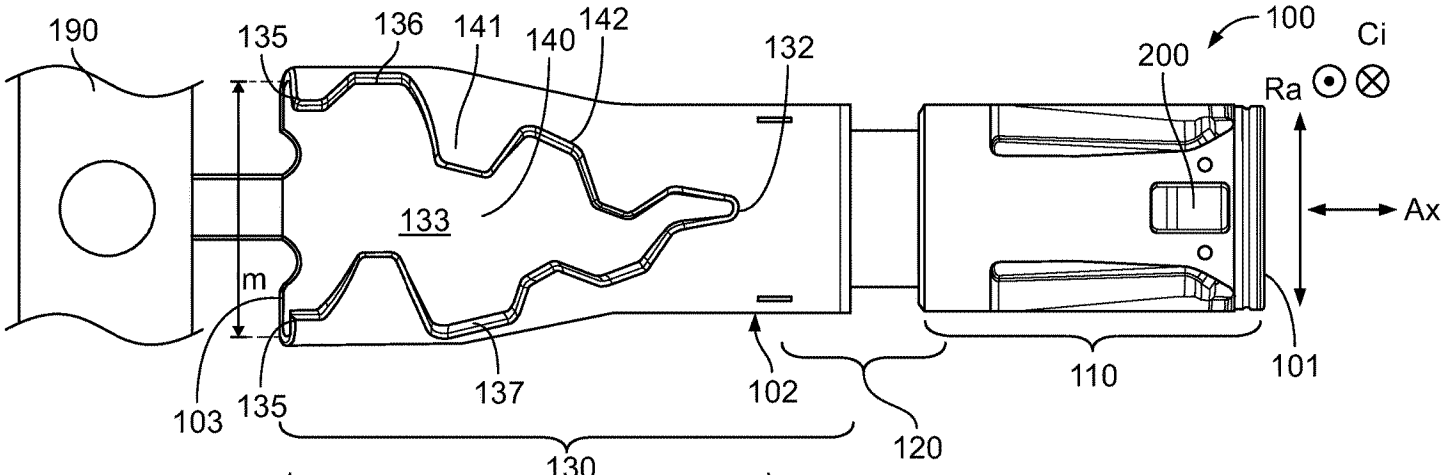
FIG. 3 is a two-dimensional top view of the shielding contact prior to crimping, wherein the inventive gaping opening of a single crimping wall of the crimping portion can be seen from above.

This location propagates from the end location 135 of the slit 134 at the rear end 103 of the shielding contact 100 to the start location of the slit 134 in the rear portion 131 or the crimping section 130, either solely, mainly, or substantially in an axial Ax direction of the shielding contact 100 (not shown); mainly or substantially in an axial Ax direction and in at least a portion additionally mainly or substantially skews in a circumferential Ci direction; or in an axial Ax and concurrently a circumferential Ci direction which is not shown. In other words, the slit 134 is free from an extension solely, mainly, or substantially in a circumferential Ci direction of the shielding contact 100. In other words, as shown in FIG. 3, a first inner edge 136 and a second inner edge 137 of the gaping opening 133 and the slit 134 always extends in a radial Ra direction (i.e., height of the slit 134) and always in axial Ax direction (i.e., length of the slit 134). In at least a portion, the first inner edge 136 and the second inner edge 137 may additionally skew in a circumferential Ci direction (i.e., length of the slit 134). In the exemplary embodiment shown in the drawings, the first inner edge 136 and the second inner edge 137 each comprise six portions extending solely substantially in an axial Ax direction of the shielding contact 100, and further each comprise five portions extending solely substantially in an axial Ax and concurrently a circumferential Ci direction of the shielding contact 100.

Figure 1:
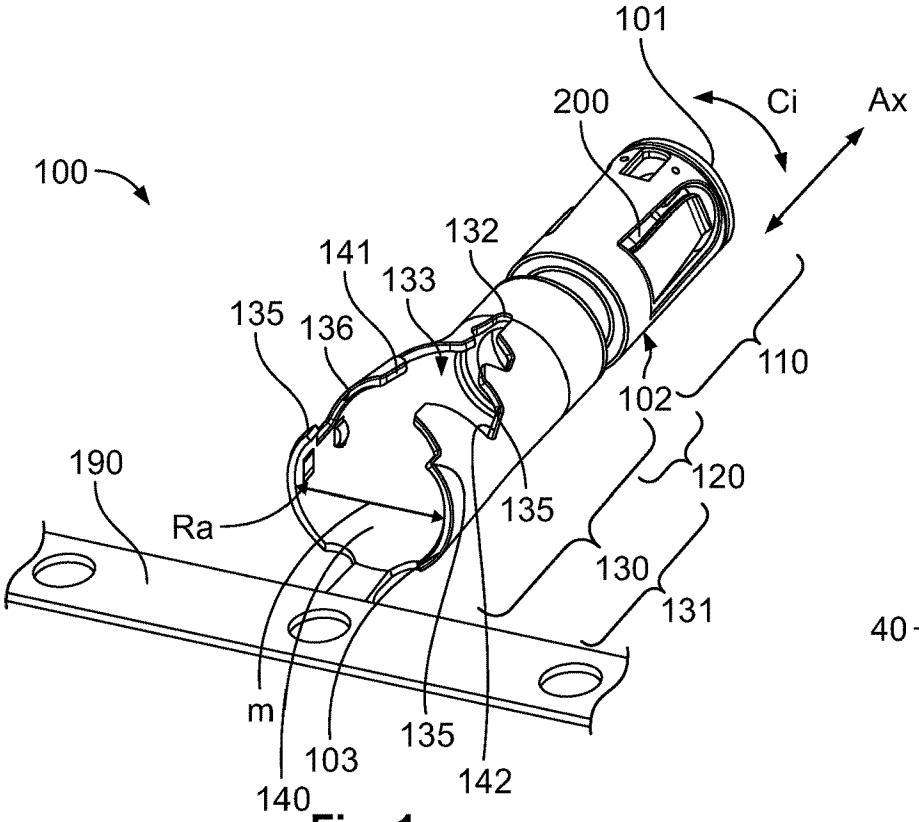
FIG. 1 is a perspective view from above and behind, the inventive electric shielding contact for an electrical cable still provided at a carrier strip, comprising the inventive rear crimping portion according to the invention.

Prior to crimping, the first inner edge 136 and the second inner edge 137 constitute the gaping opening 133, wherein the inner edges 136, 137 diverge from the start location 132 of the opening 133 to the end location 135. As shown in FIG. 1, cross-sectional measurement "m" of the shielding contact 100 of the start location 132 preferably increases permanently towards the end location 135 of the opening 133. As shown in FIG. 2, after crimping, the first inner edge 136 and the second inner edge 137 are mainly or substantially in parallel to one another and constitute the slit 134. The slit 134 has preferably mainly or substantially constant diameters "s" (i.e., shortest distances between the first edge 136 and the second edge 137) along its extension.

In a second aspect, the gaping opening 133 has the form of a serrated, toothed, or jagged spherical triangle, wherein in a third aspect the circumferential Ci direction of the teeth of the serrated, toothed, or jagged opening 133 increases towards the rear end 103. In other words, the crimping wall 140 has at least one inner tooth 141 which extends in a circumferential Ci direction and an axial Ax direction of the crimping wall 140 and further has at least one recess 142 which lies in a circumferential Ci direction and an axial Ax direction in the crimping wall 140. Preferably the inner tooth 141 tapers to its circumferential Ci outer end and the recess 142 tapers towards its circumferential Ci inner ground. In this context, the inner tooth 141 lies circumferentially Ci opposite to the corresponding recess 142, wherein the inner tooth 141 and its corresponding recess 142 are shaped mainly or substantially complementary.

Preferably a plurality of inner teeth 141, 141, . . . and recesses 142, 142, . . . are provided. In the shown exemplary embodiment, the crimping wall 140 comprises four inner teeth 141, 141, 141, 141 and four corresponding complementary recesses 142, 142, 142, 142, wherein the first inner edge 136 comprises two inner teeth 141 and two recesses 142, 142, and the second inner edge 136 also comprises two inner teeth 141 and two recesses 142, 142. A tooth 141 of an edge 136, 137 is formed complementary to the recess 142 lying directly circumferentially Ci opposite to this tooth 141.

Further, prior to crimping, the shielding contact 100 may be described as follows. In at least the rear portion 131 of the crimping section 130, the rear portion 131 and/or the crimping section 130 bulges at two longitudinal Ax sides, wherein these two sides lie circumferentially Ci opposite to one another. The gaping opening 133 is between the bulging longitudinal Ax sides. Here, a residual shielding contact 100 is preferably mainly or substantially formed as a hollow cylinder. During crimping, the two bulges of the rear portion 131 and/or the crimping section 130, and corresponding circumferential Ci portions of the crimping wall 140 are mainly or substantially formed to a hollow cylinder comprising the slit 134.

Figure 4:
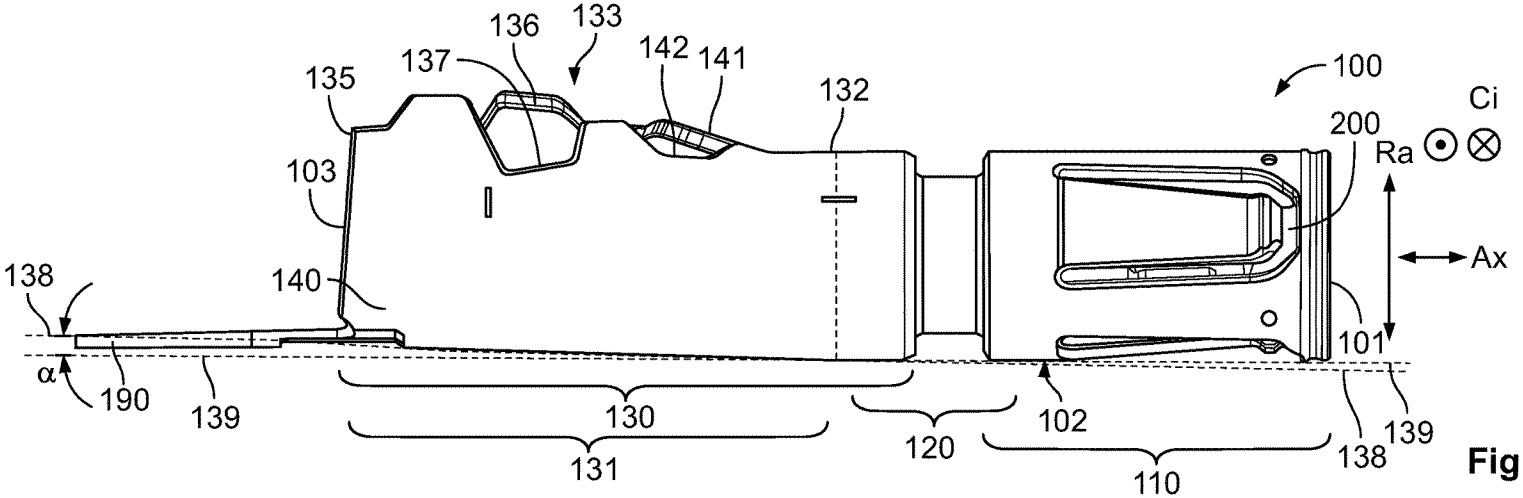
FIG. 4 is a two-dimensional side view of the inventive shielding contact from FIG. 3, wherein a portion of the crimping wall and a part of the gaping opening can be seen from a side.

According to an exemplary embodiment of the present invention as shown FIG. 4, at least a longitudinal Ax portion of the rear portion 131, the rear portion 131, or the crimping section 130 of the shielding contact 100 is angled with respect to a residual shielding contact 100, the mid-portion 102, the transitional section 120 or the contact section 110 of the shielding contact 100. In other words, a bottom line 139 of the contact section 110, the transitional section 120, the mid-portion 102, or the residual shielding contact 100, is inclined by an angle to a bottom line 138 of the crimping section 130, the rear portion 131, or the longitudinal Ax portion of the rear portion 131.

The complete electrical contact device 10, as shown in FIG. 5, comprises the electric shielding contact 100, a dielectric 200 in the shielding contact 100, and the electric contact means 300 preferably partly in the dielectric 200. The shielding contact 100, the dielectric 200, and/or the electric contact means 300 may be constituted by a plurality of (e.g., two) parts, may be made in one piece, may be made from one material piece, or may be formed integrally. The dielectric 200 functions as an electrical insulation between the shielding contact 100 and the contact means 300. Also referring to FIG. 5, the complete electrical connector 1 comprises the electrical contact device 10 and a housing (i.e., flying connector 1) or a portion of a housing (i.e., built-in connector 1).

As shown in FIGS. 2 and 5, a complete assembled or manufactured electrical coaxial cable 4 comprises the electrical coaxial cable 40, wherein the contact device 10 is mechanically and electrically connected to the coaxial cable 40. The contact means 300 is securely connected electromechanically to an inner electric conductor of the coaxial cable 40. The dielectric 200 of the contact device 10 is on and/or over the contact means 300 and, if applicable, partly on the inner electrical insulation of the coaxial cable 40. Further, the shielding contact 100 is securely connected electromechanically to an outer electric conductor and mechanically to an outer electrical insulation 410 of the coaxial cable 40. At a pre-assembled coaxial cable 4, the shielding contact 100 may be a loose part or the gaping opening 133 of the shielding contact 100 on the coaxial cable 40 may not be completely closed to form the slit 134.

What is claimed is:

1. An electric shielding contact device comprising a hollow cylindrical shielding contact having:

a contact section for electrically contacting an electric counter contact; and a crimping section;

(a) for attaching the hollow cylindrical shielding contact to an electrical cable upon crimping the crimping section, and (b) having a gaping opening shaped with a plurality of opposing edges forming a spherical triangle with at least one shape being serrated, toothed, and/or jagged and sized to become a slit when the crimping section of the hollow cylindrical shielding contact is crimped and attached to the electrical cable the slit extending in at least one of:

(1) an axial direction of the shielding contact, (2) partially in an axial direction and partially skewed from the axial direction, and (3) entirely skewed from an axial direction.

2. The electric shielding contact device according to claim 1 wherein the gaping opening in the crimping section has the form of a spherical triangle defined by:

(a) a starting location inside a material of the shielding contact, (b) an end location outside the material of the shielding contact, and (c) a part from only the start location is composed of only two opposing edges.

3. The electric shielding contact device according to claim 1, wherein a start location in the crimping section further comprises a recess in a material of the shielding contact, the recess having an extension in circumferential direction equal to or smaller than 10-times of a diameter of the slit in the closed state of the crimping section.

4. The electric shielding contact device according to claim 1, wherein a cross-sectional measurement of at least a rear portion of the crimping section is substantially the same as or greater than a cross-sectional measurement from a mid-portion in the shielding contact towards a rear end of the shielding contact along its axial direction.

5. The electric shielding contact device according to claim 1, wherein a bottom line of at least a rear portion of the crimping section is tilted at an angle to a bottom line of the contact section, wherein the angle measures less than or substantially equal to 10°.

6. The electric shielding contact device according to claim 1, further including a middle transitional section between the contact section and the crimping section.

7. The electric shielding contact according to claim 1, wherein the crimping section has:

(a) in an open state of the crimping section two edges that can be positively joined, (b) in a closed state of the crimping section two edges of the slit that are positively connected, and (c) in a positive-locking state of the crimping section two edges that are meshed with one another.

8. The electric shielding contact device according to claim 7, wherein the opposing edges of the gaping opening in the crimping section in the form of a spherical triangle has at its two inner circumferential length end portions at least one tooth and at least one recess, the at least one tooth and the at least one recess arranged complementary formed to a corresponding tooth of the opposite inner circumferential length end portion of the crimping wall.

9. The electric shielding contact according to claim 1, wherein the crimping section, when crimped, positively joins the two opposing edges.

10. The electric shielding contact device according to claim 9, wherein a circumferential direction of the toothed and recessed opposing edges nearer to the mid-portion of the shielding contact are smaller than the circumferential direction of the toothed and recessed opposing edges nearer to the rear end of the shielding contact.

11. The electric shielding contact device according to claim 1, further comprising an electrical contact means.

12. The electric shielding contact device according to claim 11, further comprising a preassembled or assembled electrical cable.

* * * * *